United States Patent [19]

Campbell et al.

[11] Patent Number: 4,462,330

[45] Date of Patent: Jul. 31, 1984

[54] CURRENT STABILIZED UNDERWATER PLATFORM

[75] Inventors: Leslie T. Campbell, Encinitas; Frank E. Gordon; Herman Torkelson, both of San Diego, all of Calif.

[73] Assignee: The United States of America as represented by the Secretary of the Navy, Washington, D.C.

[21] Appl. No.: 61,975

[22] Filed: Jul. 30, 1979

[51] Int. Cl.[3] ..... B63B 21/66

[52] U.S. Cl. ..... 114/244; 114/126; 114/312; 367/106; 367/173

[58] Field of Search ..... 367/2-4, 367/173, 106; 114/244, 245, 312, 330, 126, 144 C, 162, 121, 122, 294; 244/87; 358/99; 73/170 A, 188, 189; 405/185, 190, 191

[56] References Cited

U.S. PATENT DOCUMENTS

| | | | |
|---|---|---|---|
| 2,057,146 | 10/1936 | Heath | 358/99 |
| 2,986,109 | 5/1961 | Kittleman et al. | 114/122 X |
| 3,020,722 | 2/1962 | Harter | 405/191 |
| 3,022,462 | 2/1962 | Keiper, Jr. | 367/3 X |
| 3,626,703 | 12/1971 | Richburg | 114/312 |
| 4,080,826 | 3/1978 | Perretta | 114/144 C |

*Primary Examiner*—Sherman D. Basinger

*Attorney, Agent, or Firm*—Robert F. Beers; Ervin F. Johnston; James O. Skarsten

[57] ABSTRACT

Apparatus for providing a stable platform for equipment to be employed in an underwater environment includes a fin assembly for preventing uncontrolled azimuthal motion of the equipment when the fin assembly is suspended in the underwater environment to a level at which a current is present. The equipment is joined to a mounting which is rotatably positioned upon the fin assembly, and is oriented to a selected azimuth by the rotatable mounting in response to control signals received thereby, the fin assembly remaining at a fixed azimuthal orientation determined by the direction of the current as the mounting azimuthally displaces the equipment.

15 Claims, 8 Drawing Figures

FIG. 1.
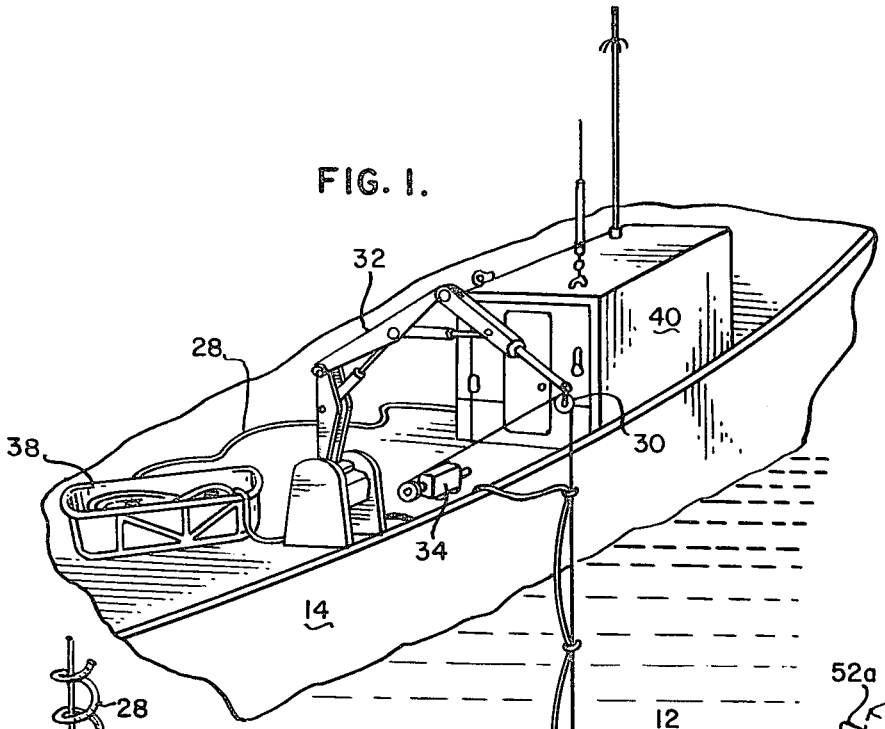
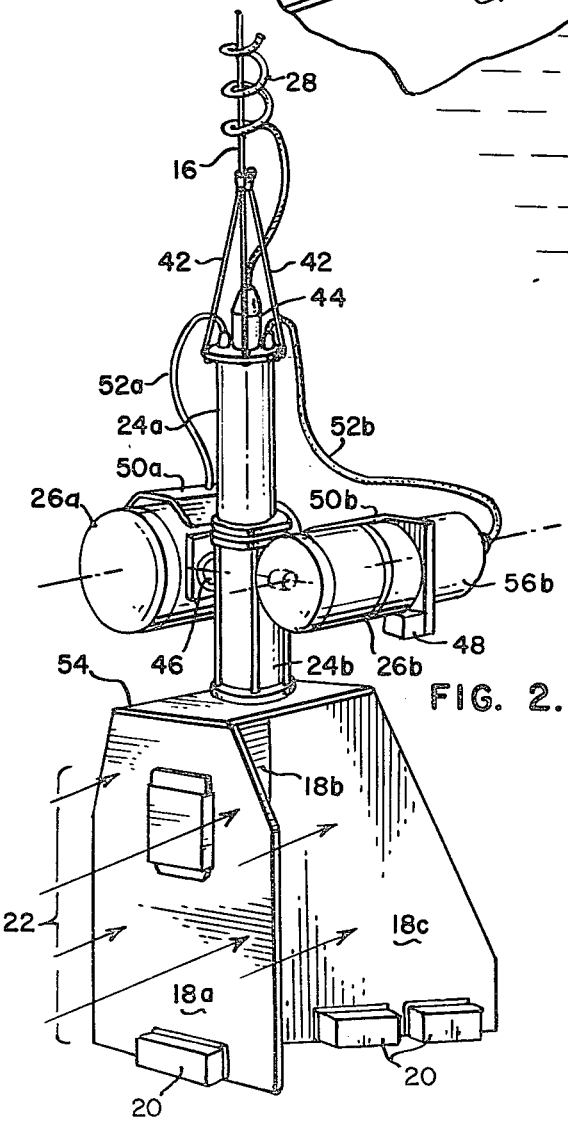
FIG. 2.
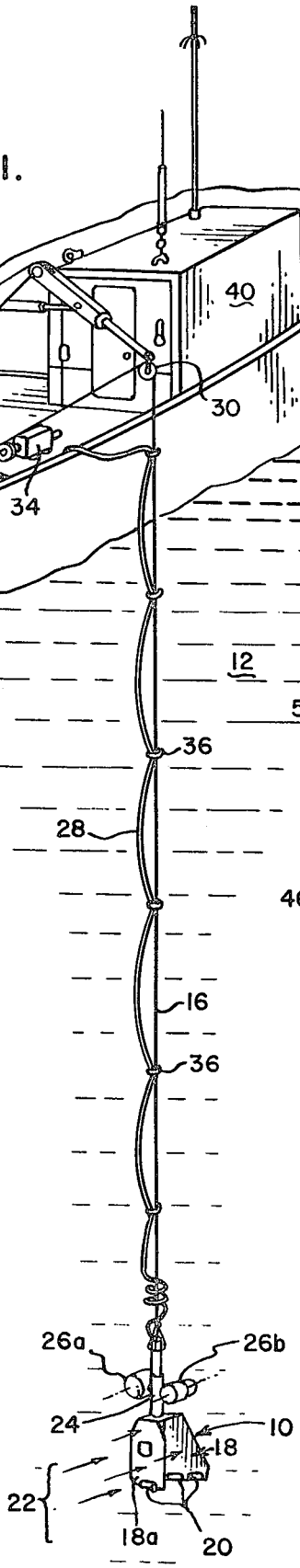
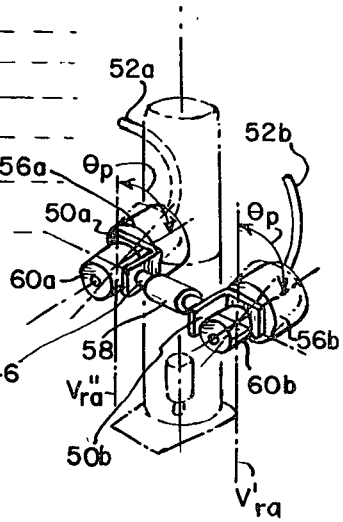
FIG. 4.

CURRENT STABILIZED UNDERWATER PLATFORM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The invention disclosed and claimed herein pertains generally to systems which include a platform suspended in an underwater environment to resist angular or other motion as equipment which is joined to the platform is controllably displaced in various degrees of motion. Even more particularly, the invention pertains to such systems wherein the platform interacts with a current present in the underwater environment in order to remain immobile as the equipment joined thereto is controllably displaced.

Certain equipments intended for operation in an underwater environment, such as an ocean body, must be selectively displaceable in one or more degrees of freedom or motion in order to accomplish desired tasks. For example, a hydrophone placed in an underwater environment to track or monitor a submarine may have to be rotatable in both a horizontal plane (azimuthal motion) and in a vertical plane (elevational motion) in order to follow a submarine as it moves through the environment. It will be readily apparent that if such equipments are not stabilized in some manner, controlled motion thereof will generate motion which is not controlled. For example, if the above hydrophone is suspended from a cable, the cable may be twisted as the hydrophone is turned through an azimuth. The twisting of the cable stores a potential energy which, upon release, will cause the hydrophone to be shifted from a desired position, if stability is not in some way provided thereto.

In a prior art system for resisting uncontrolled azimuthal motion of equipment suspended in an underwater environment, the equipment is mounted on a structure which includes an elevation trunnion and an azimuth gimbal. A servo motor is mounted on a stabilizing unit which has fins thrust outwardly into the environment. As the servo motor turns a shaft joined to the equipment, the equipment is rotated through an azimuth, while the fins resist azimuthal motion of the stabilizing unit in the water. However, such a prior art system generally requires a special winch for deployment and recovery so that its use is limited to specially equipped vessels, or else a suitable winch must be provided as part of the system. In addition, the system is deployed by suspending it from a single cable, which also includes power conductors for conveying electric power to the servo motor. As the servo motor rotates the shaft, there is sufficient azimuthal drift of the stabilizing unit that the cable is twisted enough to store a disruptive amount of potential energy. Also, slip rings are required to couple the power conductors of the cable to the servo motor as the cable is twisted. As a further disadvantage, such prior art system does not provide for controlled elevational displacement of equipment employed therewith, due to the use of a trunnion for mounting the equipment.

In a stabilizing system which improves over the above prior art, the need for comparatively expensive slip rings should be eliminated. Also, the azimuthal drift of a stabilizing platform included in the system should be eliminated or sufficiently reduced to prevent storage of potential energy in a cable from which the system is suspended. Such improved system should also provide stability for elevational or vertical displacements of equipment, as well as for azimuthal displacements thereof.

SUMMARY OF THE INVENTION

The present invention provides apparatus for enabling equipment to be controllably moved or displaced in an underwater environment. The apparatus includes a fin assembly means which makes use of the forces of a current present at a selected level in the underwater environment to prevent uncontrolled angular motion of the equipment when the fin assembly means is suspended in the environment to the selected level. The apparatus further includes movable mounting means joined to the equipment and to the fin assembly means for receiving control signals, and for selectively orienting the equipment in response to the control signals.

Preferably, the fin assembly means comprises means for maintaining a fixed azimuthal orientation in the underwater environment, even if only a current of negligible velocity is flowing against it, the fixed orientation of the fin assembly being determined by the direction of current flow. Preferably also, the movable mounting means comprises means for controllably displacing the equipment in each of a selected number of degrees of motion without displacing the fin assembly means from the fixed azimuthal orientation. For example, the mounting means usefully comprises means for displacing the equipment to provide it with both a selected azimuthal orientation and a selected elevational orientation.

In a preferred embodiment, the equipment comprises equipment having a central axis, such as a sonar transducer, and is deployed in an ocean environment or other natural body of water. The movable mounting means is rotatable joined to the fin assembly, and includes sensor means for providing equipment displacement signals which indicate the azimuthal displacement of the central axis, from the direction of magnetic north, and the elevational displacement of the central axis, from a vertical reference axis. The mounting means further includes a first servo motor, capable of turning the central axis of the transducer through several complete revolutions in a horizontal plane without displacing the fin assembly from its fixed azimuthal orientation, and a second servo motor, capable of turning the central axis through a complete revolution in a vertical plane without displacing the fin assembly. In such preferred embodiment the equipment, fin assembly and movable mounting means are suspended from a supporting cable to the selected level from a remotely located support platform, and an electric cable is provided for containing electric data paths. The data paths convey equipment displacement signals from the sensor means to the support platform, and control signals from the support platform to the servo motors, a plurality of coils of the electric cable being formed about the suspension cable to prevent twisting of the electric cable as the mounting means is turned through a number of revolutions.

Alternatively, the invention discloses apparatus which interacts with a current present at a selected level in an underwater environment to provide a stabilized platform for equipment to be employed in the environment. Such apparatus includes a facing panel having a forward side, a rearward side, two side edges and an upper end edge, the dimensions of the side edges being greater than the dimensions of the upper end edge. Such apparatus further includes a spacing panel having an upper end edge, and forward and rearward side edges which are in parallel relationship and are spaced a selected distance from each other, the forward side edge of the spacing panel being joined to the rearward side of the facing panel so that the spacing panel and the facing panel are in fixed perpendicular relationship. First and second angled panels, which are symmetrical, are also provided, each of the angled panels having a forward side edge, and upper and lower end edges, the dimensions of the forward side edges of the angled panels being greater than the dimensions of the upper and lower end edges thereof, the forward side edge of each of the angled panels being immovably joined to the rearward side edge of the spacing panel so that the upper end edges of the first and second angled panels, and also the lower end edges of the first and second angled panels, form a selected angle. Such combination of facing panel, spacing panel and angled panels cooperate to form a fin assembly for maintaining the forward side of the facing panel in perpendicular relationship with the direction of the above current when the fin assembly is positioned in the underwater environment at the level of the current. The equipment is joined to the fin assembly by mounting means which are movable in relation to the fin assembly.

OBJECTS OF THE INVENTION

An object of the present invention is to provide simplified and inexpensive apparatus for reducing or eliminating uncontrolled motion of equipment which is deployed in an underwater environment, and which must be controllably displaced or moved through various degrees of motion therein.

Another object is to provide a stabilizing platform for deploying equipment in an underwater environment which must be controllably oriented in a horizontal plane, a vertical plane, and rotated about a central axis passing through the equipment, without being affected by forces generated in response to controlled motion required for such orientations.

Another object is to provide a stabilizing fin assembly which employs the forces of a current flowing in an underwater environment to maintain a constant or fixed azimuthal orientation in relation to the direction of current flow.

Another object is to provide a stabilized platform in an underwater environment for equipment to be employed in the environment wherein the platform and equipment are deployable from a vessel equipped only with a standard deck capstan, whereby the need for a specialized winch or other deployment and recovery system is eliminated.

Another object is to avoid the need for electrically conductive slip rings in such stabilized platform systems.

These and other objects of the invention will become more readily apparent from the ensuing specification when taken together with the drawings.

BRIEF DESCRIPTION OF THE DRAWINGS

FIG. 1 is a perspective view showing an embodiment of the invention deployed in an underwater environment.

FIG. 2 is a perspective view showing the embodiment of FIG. 1 in greater detail.

FIG. 4 is a perspective view showing further details of the embodiment of FIG. 1.

DETAILED DESCRIPTION OF THE PREFERRED EMBODIMENT

Figure 5:
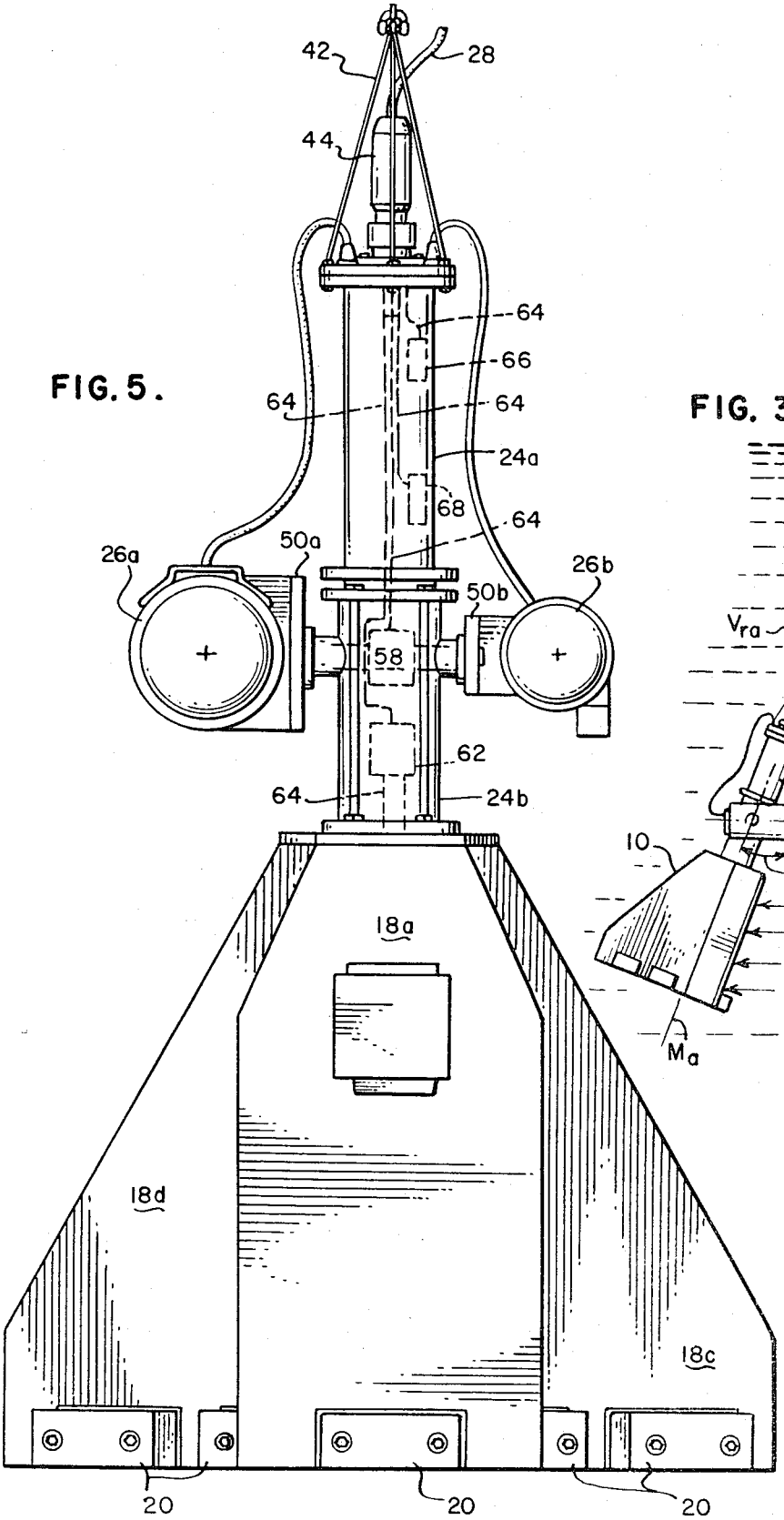
FIG. 5 is a frontal view of the embodiment of FIG. 1.

Referring to FIG. 1, there is shown a fin assembly 10 suspended into an underwater environment 12 from a surface vessel or other support platform 14 by means of a supporting cable 16. Cable 16 usefully comprises a ¼" nylon line. Fin assembly 10 is a configuration of planar members or panels 18 and weights 20, described hereinafter in greater detail, which is suspended in underwater environment 12 to a level at which at least a negligible current 22 is flowing. Fin assembly 10 is structured so that if current 22 is in the approximate range ¼–5 knots, the forward planar surface, or side, of a facing panel **18*a* will be held in a perpendicular relationship with the direction of current flow. Consequently, fin assembly 10 is maintained in a fixed azimuth, regardless of the motion of other structure attached thereto. It is anticipated that current 22 will virtually always be present to enable effective operation of fin assembly 10. For example, the required minimum quarter knot current could be provided if vessel 14** was drifting in response to a moderate wind.

Referring further to FIG. 1, there is shown fin assembly 10 and supporting cable 16 joined together by means of a tubular mounting 24, mounting 24 being movably joined to the fin assembly so that it is rotatable in relation thereto. Equipment to be employed in environment 12 which must be controllably displaced, such as sonar transducers or hydrophones **26*a* and 26*b*, are joined to tubular mounting 24, and are movable in various degrees of freedom or motion, in response to electric control signals coupled to mounting 24 through electric cable 28. Assembly 10 and mounting 24** together comprises a stabilizing platform.

To deploy the stabilizing platform and transducers 26 in environment 12, supporting cable 16 is reeved through a block 30, which is supported by boom 32, and an end of cable 16 is affixed to capstan 34. Because of the comparatively small combined weight of the platform and transducers 26, they may be readily lowered and raised in environment 12 by a capstan as small as the capstan carried aboard a tug-size vessel. Consequently, the need to provide a specialized winch which can be interfaced with the power supply of a particular vessel is eliminated.

As the platform and transducers are lowered into environment 12, personnel aboard vessel 14 join support cable 16 and electric cable 28 together at intervals by means of ties 36. FIG. 1 shows a readily transportable basket 38 aboard vessel 14 in which cable 28 may be stored in a figure-8 pattern, and from which cable 28 can readily be removed for deployment in environment 12. FIG. 1 also shows a transportable shelter 40 receiving cable 28, and housing controls by means of which an operator, stationed in shelter 40, can generate control signals coupled through cable 28.

Referring to FIG. 2, there is shown cable 16 joined to mounting 24 by means of a lifting bridle 42. FIG. 2 also shows electric cable 28 forming several loose coils about cable 16 in proximity to mounting 24. Consequently, slip rings or other rotatable devices are not required in mounting 24 to allow the passage of electric power and signals, and to prevent twisting of cable 28, as hydrophones 26 are turned through an azimuth of up to several revolutions, or 1440°. Electric cable 28 usefully comprises a fluid-filled cable containing discrete electric conductors, the end of cable 28 being joined to a pressure equalized connector 44. Connector 44 maintains a constant fluid pressure in cable 28, regardless of the ambient pressure of the environment 12 proximate to cable 28.

Referring further to FIG. 2, there is shown tubular mounting 24 comprising upper and lower housings **24*a* and 24*b*, respectively. Housing 24*a* protectably houses several electric conductor junctions and sensor devices employed to monitor the azimuthal and elevational displacements of mounting 24. Lower housing 24*b* is employed to protectably house servo motors used to pan and tilt transducers 26*a* and 26*b* in response to control signals received through electric cable 28, cable 28** also including paths for the electric power which energizes the servo motors.

Transducer **26*a* usefully comprises a device for tracking or "locking on" to a target moving through environment 12, while transducer 26*b* usefully comprises a device for receiving sonar data from a sonar source toward which the central axis of transducer 26*b* is oriented. Transducers 26*a* and 26*b* are respectively joined, in perpendicular relationship, to a shaft 46 so that the central axes of transducers 26*a* and 26*b* remain parallel, and therefore always have the same azimuths and elevation angles with respect to horizontal and vertical references. Consequently, transducers 26*a* and 26*b* cooperate to track and gather data from a target generating sonar data as the target moves through environment 12. Received sonar data is coupled to data storage or display apparatus housed in shelter 40 through conductive paths contained in electric cables 28, 52*a* and 52*b***.

Referring again to FIG. 2, there is shown a standard device 48 comprising a combination pendulus potentiometer and pressure transducer joined to transducer **26*b* by means of a bracket 50*b*. Device 48 indicates both the depth of transducers 26*a* and 26*b* in environment 12 and the pitch thereof. Pitch is the angle between the central axes of transducers 26*a* and 26*b* and vertical reference axes. Electric transducer displacement signals generated by device 48, which respectively represent the depth and pitch of the transducers, are coupled to display apparatus in shelter 40 through electric cables 52 and 28**.

Fin assembly 10, in addition to facing panel **18*a*, comprises a spacing panel 18*b*, and angled panels 18*c* and 18*d*, panel 18*d* not being shown in FIG. 2. A base panel 54 is joined to the respective upper edges of panels 18*a*–*d* to provide a firm base upon which mounting 24 is rotatably joined. Each panel is formed from a flat sheet of aluminum or other lightweight material, and weights 20** usefully are formed from stainless steel and weigh on the order of 180 pounds.

Figure 3:
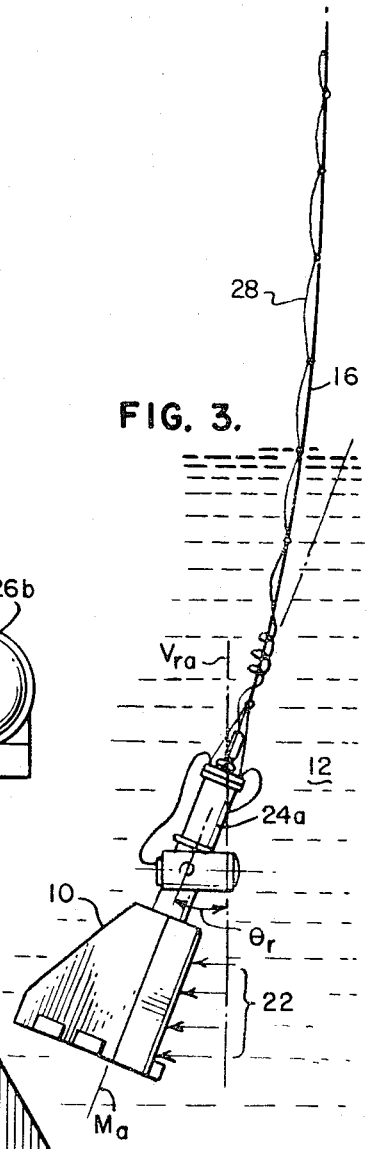
FIG. 3 is a perspective view showing the embodiment of FIG. 1 subjected to roll.

By forming panels **18*a*–*d* of light material, and by joining weights 20 to the lower portions thereof, a corrective moment is applied to fin assembly 10 and mounting 24 which urges the axis of mounting 24 to a true vertical orientation. Such moment is necessary to counteract the force of current 22 against facing panel 18*a* and angled panels 18*c* and *d* when current 22 is on the order of 5–7 knots. Such current, as shown by FIG. 3, tends to roll assembly 10 and tubular mounting 24 so that the axis $M_a$ of mounting 24 is displaced from a vertical reference axis $V_{ra}$ by an angle $\theta_r$. $\theta_r$ is on the order of 3°–5° when current 22** is on the order of 5–7 knots.

It has been found that fin assembly 10 is capable of maintaining a fixed azimuth even when $\theta_r$ is in the range 3°–5°. However, it will be readily apparent that the pitch of transducers **26*a* and *b*, the angles between their respective central axes and vertical reference axes, is varied by displacement of axis $M_a$ of mounting 24 from axis $V_{ra}$. Referring once more to FIG. 2, and also to FIG. 4, there are shown roll servo motors 56*a* and 56*b* which are respectively joined to transducers 26*a* and 26*b*. Servos 56*a* and *b* are provided to selectively rotate the transducers about their respective central axes to compensate for disorientation of the transducers due to rolling of mounting 24. Servos 56*a* and *b* are operated by electric power and control signals coupled thereto by an operator in shelter 40 through cables 28 and 52*a* and *b***.

Referring further to FIG. 4, there is shown shaft 46 passing through lower housing **24*b* in transverse relationship thereto. Shaft 46 is rotated by a pitch servo motor 58 contained in lower housing 24*b* to elevationally displace the central axes of transducers 26*b* and *a* by pitch angles $\theta_p$, in relation to vertical reference angles $V_{ra}'$ and $V_{ra}''$, respectively. Pitch servo 58 is operated by electric power and control signals coupled thereto from shelter 40 through electric cable 28. FIG. 4 also shows shafts 60*a* and 60*b* transversally joined to the ends of shaft 46 by means of brackets 50*a* and 50*b* respectively, and respectively joining transducer 26*a* and roll servo 56*a* and transducer 26*b* and roll servo 56*b***.

Referring to FIG. 5, there is shown lower housing **24*b* containing pitch servo 58 and also containing an azimuth servo motor 62. Servo 62 turns a shaft 64 which has an end fixably joined to fin assembly 10, so that tubular mounting 24 is rotated about its central axis, fin assembly 10 maintaining a fixed azimuth in response to current 22. Transducers 26*a* and *b* may thereby be directed to a selected azimuth by selectively coupling power and control signals to servo 62 through electric conductors 64 and cable 28. Servos 58 and 62 of lower housing 24*b***, together with conventional bearings and linkages contained therein, usefully comprises a standard pan and tilt apparatus.

Referring further to FIG. 5, there is shown upper housing **24*a* containing a magnetic compass 66, and an pendulus potentiometer 68. Compass 66 is joined to housing 24*a* in such a relation to the central axes of transducers 26 that, as the central axes are turned through a horizontal plane, compass 66 generates a signal representing the angular displacement of the central axes from the direction of magnetic north. Such displacement signal, representing the azimuth of transducers 26, is coupled through an electric conductor 64 and cable 28 to a display apparatus in shelter 40. In like manner, pendulus potentiometer 68 couples a signal representing roll angle $\theta_r$ through cable 28 to a display in shelter 40. It is to be noted that an operator, by observing displayed signals representing the azimuth and pitch of transducers 26 and the roll angle of mounting 24, is enabled to send control signals to servo motors 56***a*, 56*b*, 58 and 62 to selectively orient the transducers.

Figure 6:
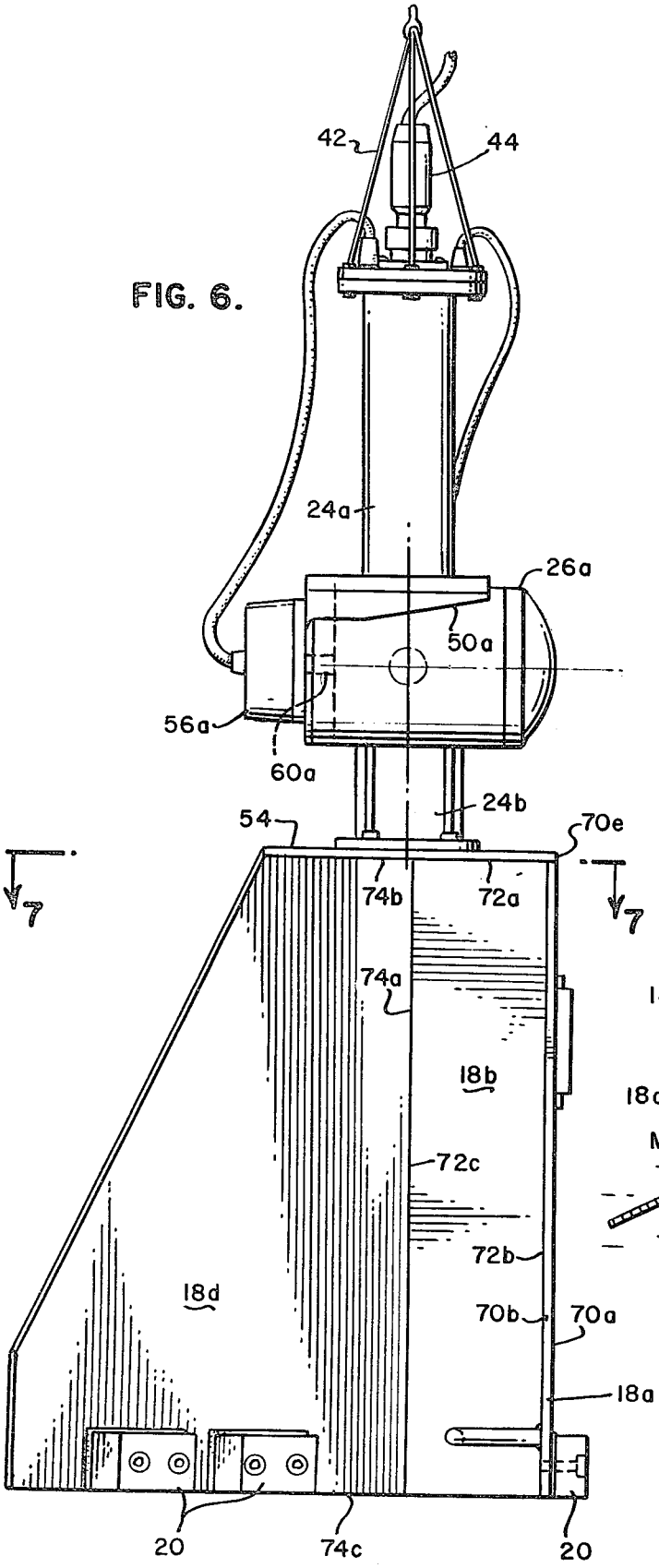
FIG. 6 is a side view of the embodiment of FIG. 1.
Figure 7:
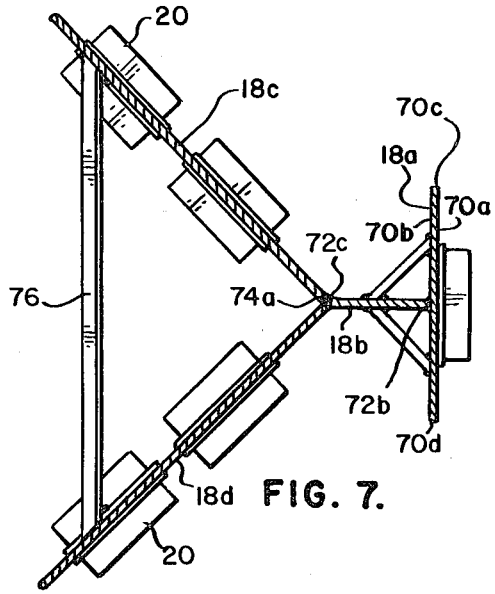
FIG. 7 is a cross-sectional view of the fin assembly of the embodiment of FIG. 1 taken along lines 7—7 of FIG. 5.

Referring to FIGS. 6 and 7, there are shown a side view of mounting 24, transducers 26 and fin assembly 10, and a cross-sectional view of FIG. 6 taken along lines 7—7 thereof, respectively. FIGS. 6 and 7 show facing panel 18*a* having a forward side 70*a*, a rearward side 70*b*, two side edges 70*c* and 70*d*, respectively, and an upper end edge 70*e*. Spacing panel 18*b* has an upper end edge 72*a* and forward and rearward side edges 72*b* and *c* respectively, which are in parallel relationship and spaced a selected distance from each other. Forward side edge 72*b* is joined to rearward side 70*b* of facing panel 18*a* midway between side edges 70*c* and 70*d*, so that spacing panel 18*b* and facing panel 18*a* are in fixed perpendicular relationship. Angled panels 18*c* and 18*d* are symmetrical, each having a forward side edge 74*a* and upper and lower end edges 74*b* and *c*, respectively. The forward side edge 74*a* of each angled panel is immovably joined to rearward side edge 72*c* of spacing panel 18*b* so that upper end edges 74*b* of angled panels 18*c* and 18*d* together form a 90° angle, lower end edges 74*c* of angled panels 18*c* and 18*d* also forming a 90° angle. Angled panels 18*c* and 18*d* each forms an angle with spacing panel 18*b* which is on the order of 135°. FIG. 7 further shows a bracing member 76 joined between angled panels 18*c* and *d* to maintain them in rigid relationship with each other.

Facing panel 18*a* usefully has an area on the order of 8 sq. ft., and side edges 70*c* and *d* thereof are 4 ft. The spacing between side edges 72*b* and 72*c* is 1 ft., and the areas of angled panels 18*c* and *d* are on the order of 11.5 sq ft. While the above dimensions for fin assembly 10 may be varied to accommodate transducers or other equipments of varying size, the ratios or relationships therebetween should remain relatively constant.

Figure 8:
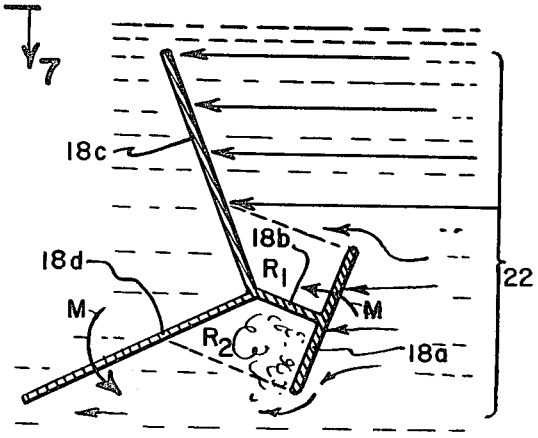
FIG. 8 is a schematic view of a cross-section of the fin assembly means of the embodiment of FIG. 1 to illustrate the operation thereof in response to an underwater current.

Referring to FIG. 8, there is shown fin assembly 10, assembly 10 initially receiving current 22. When facing panel 18*a* is not in perpendicular relationship with the direction of current flow, a region $R_1$ is formed which has a very low pressure in comparison with the pressure adjacent to forward side 70*a* of panel 18*a*. Region $R_1$ is bounded by spacing panel 18*b*, facing panel 18*a*, angled panel 18*c*, and a line extended between facing panel 18*a* and angled panel 18*c* in perpendicular relation with panel 18*a*. A region $R_2$ is also formed which is bounded by facing panel 18*a*, spacing panel 18*b*, angled panel 18*d*, and a line extending between angled panel 18*d* and facing panel 18*a*, and in perpendicular relationship therewith. However, region $R_2$ contains turbulence, and the pressure therein is comparatively higher than the pressure within region $R_1$. Consequently, a substantial pressure differential is created between current 22 and region $R_1$ so that a moment M is applied to fin assembly 10, whereby fin assembly 10 is turned until facing panel 18*a* is in perpendicular relationship to the direction of flow of current 22. If the current velocity is at least $\frac{1}{4}$ knot, facing plate 18*a* will be maintained in perpendicular relationship with the direction of current flow despite motion of transducers 26 in response to control signals coupled servo motors.

It will be apparent that additional transducers or other equipment requiring selctive displacement in environment 12 may be readily emplaced upon the mounting 24 without requiring more than negligible alteration of the above embodiment. Such equipments may be operated by means of electric cables in addition to cable 28, which may be readily joined to support cable 16 and mounting 24 in the manner illustrated for cable 28.

Obviously, many modifications and variations of the present invention are possible in the light of the above teachings, and, it is therefore understood that within the scope of the disclosed inventive concept, the invention may be practiced otherwise than specifically described.

What is claimed is:

1. Apparatus for enabling equipment to be controllably operated at a selected level in an underwater environment when a current of at least negligible velocity is flowing in said environment at said level, said apparatus comprising:

a facing panel having a forward side and a rearward side;

means joined to said rearward side of said facing panel for interacting with said current to retain said forward side of said facing panel in substantially perpendicular relationship with the direction of said current, said facing panel and said current interaction means together comprising a fin assembly means; and movable mounting means joined to said equipment and to said fin assembly means for receiving control signals, and for selectively orienting said equipment in response to said control signals.

2. The apparatus of claim 1 wherein:

said current interaction means comprises a pair of angled panels having forward edges, said angled panels being joined together along their respective forward edges at a selected angle, each of said angled panels being joined to the rearward side of said facing panel along its forward edge so that current flowing past a first side edge of said facing panel encounters at least a portion of one of said angled panels, and so that current flowing past a second side edge of said facing panel encounters at least a portion of the other of said angled panels;

said movable mounting means comprises means for controllably displacing said equipment in each of a selected number of degrees of motion ; and the respective dimensions of said facing panel and said angled panels are selected in relation to one another for enabling said fin assembly to be maintained in a fixed azimuthal orientation by said flowing current when said movable mounting means displaces said equipment in said degrees of motion.

3. The apparatus of claim 2 wherein:

said movable mounting means comprises means rotatably joined to said fin assembly means for turning said equipment through an azimuth which exceeds one complete revolution without displacing said fin assembly means from said fixed orientation.

4. The apparatus of claim 2 wherein said movable mounting means includes: sensor means for providing an equipment displacement signal which indicates the displacement of said equipment from a selected reference in each of said selected degrees of motion; and motor means receiving said control signals for selectively displacing said equipment in relation to a reference in each of said degrees of motion without displacing said fin assembly means from said fixed azimuthal orientation.

5. The apparatus of claim 4 wherein:

said movable mounting means includes a housing means for enclosing said sensor means and said motor means;

said apparatus includes a supporting cable for suspending said equipment, fin assembly means and movable mounting means to said selected level in said underwater environment from a remotely located support platform; and said apparatus further includes an electric cable for containing electric data paths which convey said equipment displacement signals from said sensor means to said support platform, and said control signals from said support platform to said motor means, a plurality of coils of said electric cable being formed about said suspension cable in proximity to said housing means.

6. The apparatus of claim 5 wherein:

said sensor means includes a compass means for providing a reference for azimuthal displacements of said equipment, and further includes a pendulum means for providing a reference for elevational displacements of said equipment; and said motor means comprises a first servo motor for rotating said housing in relation to said fin assembly means to direct said equipment to a specified azimuth in relation to said azimuthal reference, and a second servo motor for directing said equipment to a specified angle of elevation in relation to said elevational reference.

7. The apparatus of claim 6 wherein:

said compass means comprises means for providing a displacement signal which represents the angular displacement between said equipment and magnetic north; and said pendulum means comprises means for providing a displacement signal which represents the angular displacement of said equipment from a vertical axis.

8. The apparatus of claim 5 wherein said equipment comprises a device for monitoring a source of sonar data moving through said underwater environment and wherein:

said motor means comprises a first servo motor for moving said monitoring device through an azimuth, and a second servo motor for moving said device through an elevational angle, so that a central axis passing through said monitoring device remains directed toward said moving source.

9. The apparatus of claim 8 wherein said monitoring device is rotatable about said axis, and wherein:

said motor means includes a third servo motor for selectively rotating said monitoring device about said central axis.

10. Apparatus for providing a stabilized platform in an underwater environment for equipment to be employed in said environment, said apparaus comprising:

a facing panel having a forward side, a rearward side, two side edges and an upper end edge, the dimension of said side edges being greater than the dimensions of said upper end edge;

a spacing panel having an upper end edge, and forward and rearward side edges which are in parallel relationship and are spaced a selected distance from each other, said forward side edge of said spacing panel being joined to said rearward side of said facing panel so that said spacing panel and said facing panel are in fixed perpendicular relationship;

first and second angled panels, said angled panels being symmetrical, each of said angled panels having a forward side edge and upper and lower end edges, the dimensions of said forward side edges of said angled panels being greater than the dimensions of said upper and lower end edges of said angled panels, the forward side edge of each of said angled panel being immovably joined to said rearward edge of said spacing panel so that the upper end edges of said first and second angled panels, and also the lower end edges of said first and second angled panels, form a selected angle;

said facing panel, said spacing panel and said first and second angled panels cooperating to form a fin assembly for maintaining said forward side of said facing panel in perpendicular relationship with the direction of a current flowing in said underwater environment when said fin assembly is positioned in said underwater environment at the level of said current; and means for movably mounting said equipment to said fin assembly.

11. The apparatus of claim 10 wherein:

a base panel is immovably joined to said upper end edges of said facing panel, said spacing panel, and said angled panels;

said movable mounting means includes a housing rotatably joined to said base panel, said equipment being joined to said housing; and said movable mounting means further includes means for rotating said housing and said equipment through an azimuth which exceeds a plurality of complete revolutions without disturbing said perpendicular relationship between said facing panel and said current direction.

12. The apparatus of claim 11 wherein said azimuth rotation means comprises:

a compass means enclosed in said housing for providing a reference for azimuthal rotation of said equipment, said compass means including means for providing data which indicates the azimuth of said equipment in relation to said azimuth reference; and said azimuth rotation means further includes an azimuth servo motor enclosed in said housing for rotating said housing in response to control signals received from a remote location.

13. The apparatus of claim 12 wherein said apparatus and said equipment are suspended into said underwater environment by a supporting cable, and wherein:

said azimuth rotation means includes an electric cable coupled between said housing and said remote location for conveying said azimuth data from said compass means to said remote location and for conveying said control signals from said remote location to said azimuth servo motor, said electric cable being enabled to coil around said supporting cable when said equipment is rotated through a plurality of azimuthal revolutions without storing more than a negligible amount of potential energy.

14. The apparatus of claim 11 wherein:

said housing comprises a cylindrical housing, one end of said cylindrical housing being rotatably joined to said base panel;

a rotatable shaft passes through said housing transversally to the axis of said housing, said equipment being joined to said shaft outside of said houing; and elevation motor means are joined to said shaft for selectively displacing said equipment in relation to a vertical elevation reference.

15. Apparatus for enabling equipment to be controllably operated at a selected level in an underwater environment when a current of at least negligible velocity is flowing in said environment at said level, said apparatus comprising:

a facing panel having a forward side and rearward side;

means joined to said rearward side of said facing panel for interacting with said current to retain said forward side of said facing panel in substantially perpendicular relationship with the direction of said current, said facing panel and said current interaction means together comprising a fin assembly means; and movable mounting means joined to said equipment and to said fin assembly means for receiving control signals, for selectively orienting said equipment in response to said control signals, and including means for controllably displacing said equipment in each of a selected number of degrees of motion;

said current interaction means including a pair of angled panels having forward edges, said angled panels being joined together along their respective forward edges at a selected angle, each of said angled panels being joined to the rearward side of said facing panel along its forward edge so that current flowing past a first side edge of said facing panel encounters at least a portion of one of said angled panels, and so that current flowing past a second side edge of said facing panel encounters at least a portion of the other of said angled panels;

the respective dimensions of said facing panel and said angled panels being selected in relation to one another for enabling said fin assembly to be maintained in a fixed azimuthal orientation by said flowing current when said movable mounting means displaces said equipment is said degrees of motion;

the movable mounting means including: (1) sensor means for providing an equipment displacement signal which indicates the displacement of said equipment from a selected reference in each of said selected degrees of motion; (2) motor means receiving said control signals for selectively displacing said equipment in relation to a reference in each of said degrees of motion without displacing said fin assembly means from said fixed azimuthal orientation; and (3) a housing means for enclosing said sensor means and said motor means;

said apparatus including: (1) a supporting cable for suspending said equipment, fin assembly means and movable mounting means to said selected level in said underwater environment from a remotely located support platform; and (2) an electric cable for containing electric data paths which convey said equipment displacement signals from said sensor means to said support platform, and said control signals from said support platform to said motor means, a plurality of coils of said electric cable being formed about said suspension cable in proximity to said housing means;

said equipment including a device for monitoring a source of sonar data moving through said underwater environment;

said motor means including a first servomotor for moving said monitoring device through an azimuth, a second servomotor for moving said device through an elevational angle so that a central axis passing through said monitoring device remains directed toward said moving source, and a third servomotor for selectively rotating said monitoring device about said central axis.

* * * * *